US011528959B2

(12) United States Patent
Geis et al.

(10) Patent No.: US 11,528,959 B2
(45) Date of Patent: Dec. 20, 2022

(54) ATHLETIC SHOE WITH A SHELL INSERTED BETWEEN THE UPPER AND A COMFORT SOLE

(71) Applicant: The North Face Apparel Corp., Wilmington, DE (US)

(72) Inventors: Benoit Geis, Wattwiller (FR); Wu Shengching, Taichung (TW)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 16/772,268

(22) PCT Filed: Dec. 6, 2018

(86) PCT No.: PCT/US2018/064292
§ 371 (c)(1),
(2) Date: Jun. 12, 2020

(87) PCT Pub. No.: WO2019/118276
PCT Pub. Date: Jun. 20, 2019

(65) Prior Publication Data

US 2021/0085025 A1 Mar. 25, 2021

(30) Foreign Application Priority Data

Dec. 13, 2017 (FR) ..... 1701302

(51) Int. Cl.
*A43B 13/14* (2006.01)
*A43B 5/00* (2022.01)
(Continued)

(52) U.S. Cl.
CPC ..... *A43B 13/141* (2013.01); *A43B 5/00* (2013.01); *A43B 13/026* (2013.01); *A43B 13/04* (2013.01)

(58) Field of Classification Search
CPC ..... A43B 13/12; A43B 13/125; A43B 13/127; A43B 13/14; A43B 13/141; A43B 13/181
See application file for complete search history.

(56) References Cited

U.S. PATENT DOCUMENTS 2,674,051 A * 4/1954 Ridderstrom ..... A43B 9/06 36/19 R
4,827,631 A * 5/1989 Thornton ..... A43B 3/00 36/102
(Continued)

FOREIGN PATENT DOCUMENTS

EP 3114955 A1 1/2017
EP 3114956 A1 1/2017
(Continued)

OTHER PUBLICATIONS

International Search Report and Written Opinion dated Feb. 15, 2019 for Application No. PCT/US2018/064292; 7 pages.
(Continued)

*Primary Examiner* — Jameson D Collier
(74) *Attorney, Agent, or Firm* — Smith, Gambrell & Russell LLP

(57) ABSTRACT

An athletic shoe extending between toe (1) and heel (3) and comprising upper (5) attached to outsole (7) via comfort sole (9). According to the invention, the athletic shoe comprises shell (13) make of plastic or composite material, inserted between upper (5) and comfort sole (9) and to which it is attached at heel (1).

15 Claims, 6 Drawing Sheets

(51) Int. Cl.
*A43B 13/02* (2022.01)
*A43B 13/04* (2006.01)

(56) References Cited

U.S. PATENT DOCUMENTS

| | | | | |
|---|---|---|---|---|
| D573,336 | S * | 7/2008 | Rivas | D2/961 |
| 2002/0050078 | A1* | 5/2002 | Dietrich | A43B 7/24 36/88 |
| 2004/0194351 | A1* | 10/2004 | Gallegos | A43B 3/24 36/140 |
| 2005/0262728 | A1 | 12/2005 | Robbins | |
| 2007/0017123 | A1 | 1/2007 | Scofield et al. | |
| 2009/0090027 | A1* | 4/2009 | Baudouin | A43B 13/12 36/93 |
| 2011/0179669 | A1 | 7/2011 | Hanebrink et al. | |
| 2011/0197475 | A1* | 8/2011 | Weidl | A43B 1/0072 36/107 |
| 2012/0167416 | A1* | 7/2012 | Christensen | A43B 3/0057 36/103 |
| 2014/0310981 | A1* | 10/2014 | Abshire | A43B 7/1445 36/28 |
| 2015/0052782 | A1 | 2/2015 | Christensen et al. | |
| 2015/0089841 | A1 | 4/2015 | Smaldone et al. | |
| 2015/0173456 | A1* | 6/2015 | Rushbrook | A43B 5/001 36/25 R |
| 2019/0208862 | A1 | 7/2019 | Poegl et al. | |

FOREIGN PATENT DOCUMENTS

| | | | |
|---|---|---|---|
| EP | 3315040 | A2 | 5/2018 |
| FR | 2898252 | A1 | 9/2007 |
| JP | 2000-102402 | A | 4/2000 |
| JP | 2005-342519 | A | 12/2005 |
| JP | 2006-334400 | A | 12/2006 |
| TW | M565986 | U | 9/2018 |
| WO | 2017/045018 | A1 | 3/2017 |
| WO | 2017/058420 | A1 | 4/2017 |

OTHER PUBLICATIONS

European Search Report and Written Opinion received for EP Patent Application No. 18889035.4, dated Mar. 29, 2022, 15 pages.

* cited by examiner

ATHLETIC SHOE WITH A SHELL INSERTED BETWEEN THE UPPER AND A COMFORT SOLE

CROSS-REFERENCE TO RELATED APPLICATION

This application is a National Phase filing of International (PCT) Application Number PCT/US2018/064292, filed Dec. 6, 2018, which claims the benefit of French Application Number 1701302, filed Dec. 13, 2017, each of which are hereby incorporated by reference in their entirety.

BACKGROUND

The invention pertains to an athletic shoe specifically comprised of an upper attached to an outsole via a comfort sole.

A shoe of this type is known from document EP 3 114 955. From the heel to the toe of the shoe, a rubber outsole is attached to a first comfort sole made of expanded polyurethane. A second ethylene-vinyl acetate (EVA) comfort sole is perforated, so that the upper is attached to the first sole and the second comfort sole. The expanded polyurethane increases the cushioning effect of the first comfort sole.

Document FR 2 898 252 also describes an athletic shoe of the type indicated in the introduction, but which is distinguished by the fact that a two-part composite material insert is attached to the outsole and the comfort sole at the heel and attached to the comfort sole and the upper at the toe of the shoe. This part of the composite material insert increases the elasticity of the toe of the shoe.

According to this prior art, it is found that at the heel, the upper is in direct contact with the comfort sole. The object of the invention is to modify this prior art in order to better control the support phase of the athletic shoe.

SUMMARY

For this purpose, the subject of the invention is an athletic shoe conforming to the type indicated in the introduction, characterized in that it comprises a shell made of plastic or composite material inserted between the upper and the comfort sole and with which it is attached at the heel.

The shell, made of plastic or composite material, imparts torsional and flexural rigidity to the upper that counteracts foot displacement during impacts between the heel of the shoe and the ground and thus contributes to the stability of the support. By elastically deforming, it also allows a fraction of the energy released by the shock to be restored during relaxation by reducing the fraction of energy dissipated by the comfort sole.

Preferably, the shell of plastic or composite material is inserted and attached to the upper and the comfort sole up to the toe.

Through this arrangement, the shell deforms elastically during the entirety of a stride, from the heel to the toe of the shoe, and provides a stimulating effect to the foot enclosed by the upper by returning the stored energy.

Also preferably, the plastic shell or composite material is inserted and attached to the upper and the comfort sole via a shell bottom and a shell side.

The shell side forms an edge around the shell bottom to allow the shell to stabilize the foot vis-à-vis the ground during a stride, on the one hand. The foot enclosed by the upper is thus kept in the alignment held by the shoe at the time of the impact of the heel with the ground. On the other hand, the edge of the shell side increases the shell's flexional and torsional rigidity. This arrangement is more specifically suitable for road running.

In one embodiment, the shell side surrounds a portion of the shell bottom corresponding to the heel and is disconnected along a portion of said shell bottom corresponding to the toe.

The disconnection of the shell side gives the toe of the shoe flexibility while maintaining stiffness in the heel. This arrangement is more specifically suitable for track running.

In another embodiment, the shell side forms an edge around said shell bottom.

The shell side forms an edge around the shell bottom to allow the shell to stabilize the foot vis-à-vis the ground during a stride, on the one hand. The foot enclosed by the upper is thus kept in the alignment held by the shoe at the time of the impact of the heel with the ground. On the other hand, the edge of the shell side increases the shell's flexional and torsional rigidity. This arrangement is more specifically suitable for road running.

Preferably, the shell side is equipped with notches.

This arrangement makes it possible to vary the stiffness of the shell by delimiting rigid sections of the shell side, causing flexibility between the sections due to the notches. It is particularly suitable for mountain runs, known as "trail running".

Also, preferably, the shell bottom is perforated.

A perforated shell bottom makes it possible to reduce the weight of the shell while maintaining the rigidity supplied by the shell side.

Advantageously, the comfort sole has a radius of curvature at all points of a line from the heel to the toe and creates an interface with the outsole.

The curvature of the comfort sole eliminates the overlap effect of the initial impact felt with a comfort sole without curvature. The transition between the impact and the roll of the foot is instantaneous. Combined with the stiffness of the composite shell, the bend of the comfort sole promotes the return of energy and thereby permitting faster, and therefore more powerful, strides.

Other advantages of the invention will emerge in the description of embodiments illustrated by the drawings.

DETAILED DESCRIPTION

Figure 1:
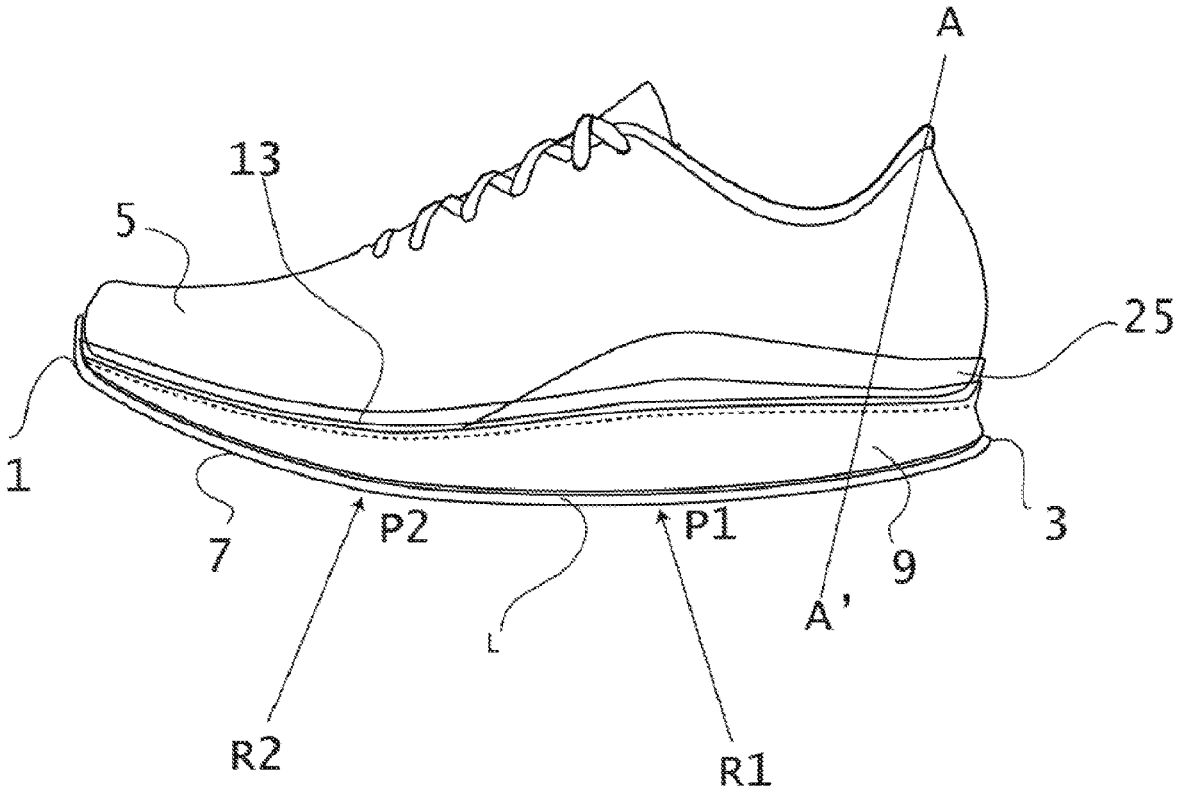
FIG. 1 is a side view of a first embodiment of the invention.
Figure 3:
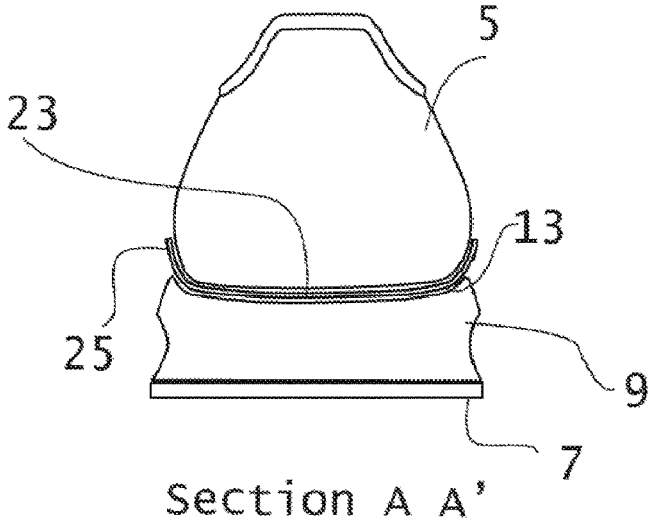
FIG. 3 is a view along cross-section A-A' of FIG. 1.
Figure 2:
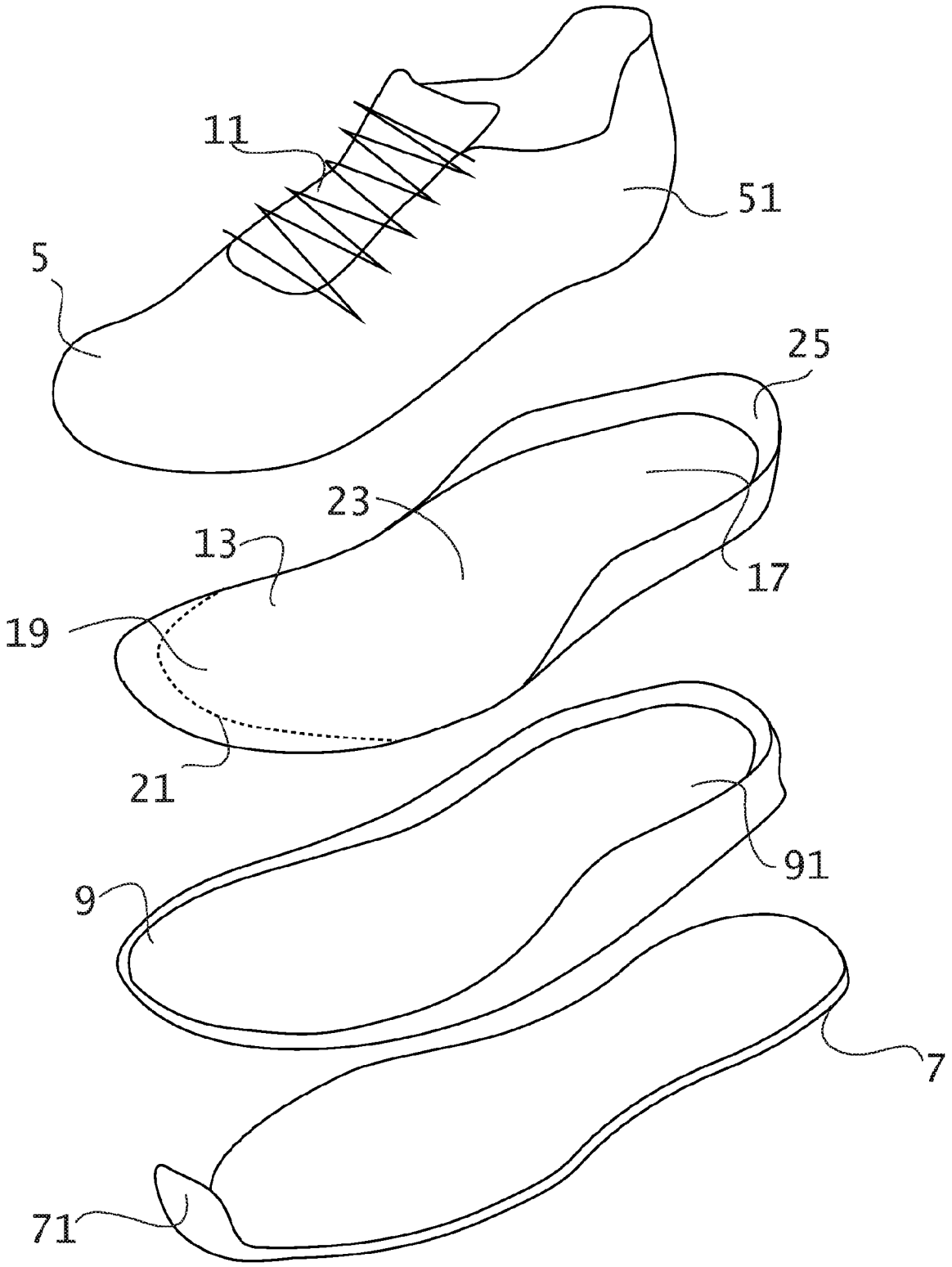
FIG. 2 is an expanded view of FIG. 1.

According to a first embodiment of the invention, FIGS. 1 to 3, an athletic shoe extends between toe 1 and heel 3 and comprises upper 5 attached to outsole 7 via comfort sole 9.

Outsole 7 is made of an adherent material such as a rubber and is intended to provide a good grip on the ground and good resistance to abrasion. Comfort sole 9 acts as a shock absorber and absorbs shocks during the shoe's contact with the ground, in particular by heel 3. It also has controlled torsional and flexional rigidity characteristics. Upper 5 serves to keep the foot enclosed in the shoe, and for this purpose, it is provided with closure system 11 using laces or quick fastener strips. Outsole 7 and comfort sole 9 are connected to each other, for example by gluing, from toe 1 to heel 3. Outsole 7 may be equipped with tip 71 at toe 1 of the shoe.

According to the invention, the athletic shoe comprises shell 13 made of plastic or composite material, inserted between upper 5 and comfort sole 9 and to which it is attached to heel 3. Corresponding to heel 3 of the shoe, rear portion 51 of upper 5 is, for example, glued to rear portion 17 of shell 13, and likewise, said rear portion 17 is glued to rear portion 91 of comfort sole 9. Gluing can be replaced by cementing.

In the embodiment illustrated in FIGS. 1 to 3, shell 13 extends from rear portion 17 corresponding to heel 3, to front portion 19 corresponding to toe 1. However, shell 13 may only extend for a distance less than the distance between heel 3 and toe 1. Reference 21 has a dotted line showing an end of front portion 19 of shell 13, at a distance from rear portion 17 that is less than the distance between heel 3 and toe 1 of the shoe. In this case, upper 5 is in direct contact with comfort sole 9 in the part of toe 1 of the shoe where shell 13 is not inserted.

Shell 13 is inserted between upper 5 and comfort sole 9 and attached to these two elements by heel 3 in order to impart, on the one hand, torsional and flexional rigidity to the upper.

During the impact of the heel 3 of the shoe and the ground, shell 13 counteracts displacement of the foot enclosed in upper 5, thus contributing to the stability of the support. On the other hand, the shell is made of plastic or composite material to allow a fraction of the energy released by the impact to be restored during relaxation by reducing the fraction of energy dissipated by the comfort sole.

Shell 13 is attached to upper 5 and comfort sole 9 via shell bottom 23 and shell side 25.

In this first embodiment, the shell side surrounds bottom shell 23 along rear portion 17 of shell 13 corresponding to heel 1 and is disconnected along shell bottom 23 in front portion 19 of shell 13 corresponding to toe 1.

As indicated above, the disconnection of shell side 25 gives toe 1 of the shoe flexibility while maintaining stiffness in heel 3. This arrangement is more specifically suitable for track running.

Figure 4:
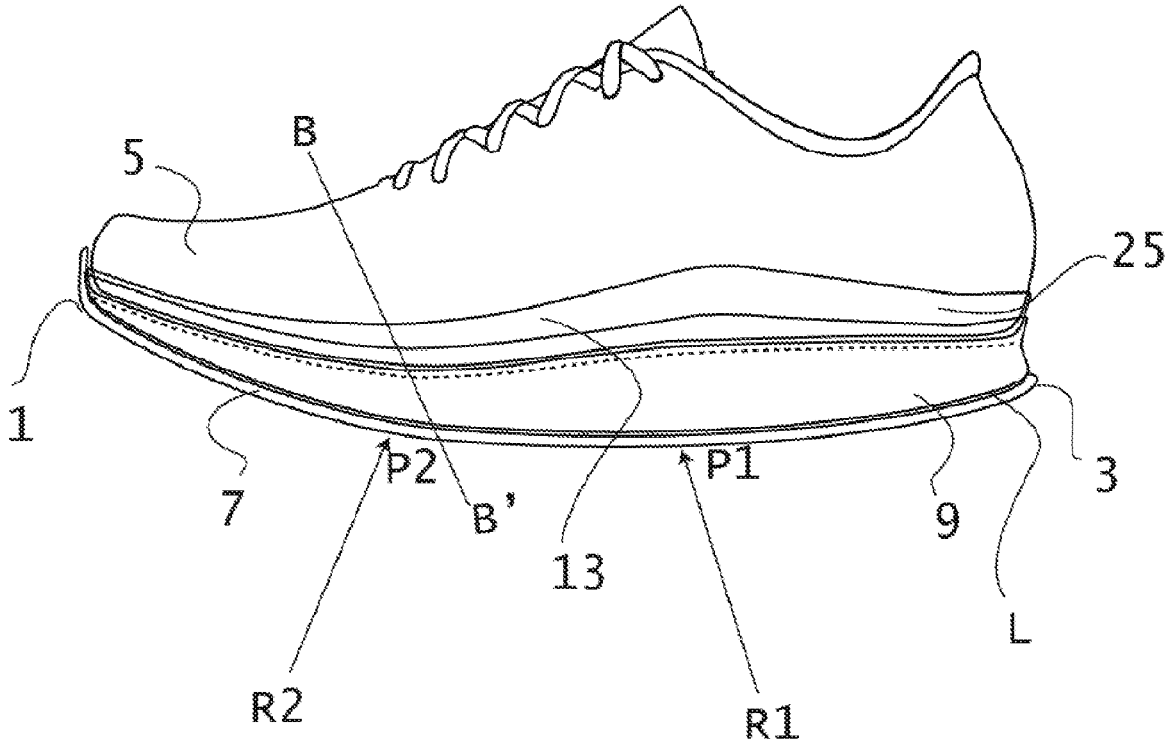
FIG. 4 is a side view of a second embodiment of the invention.
Figure 6:
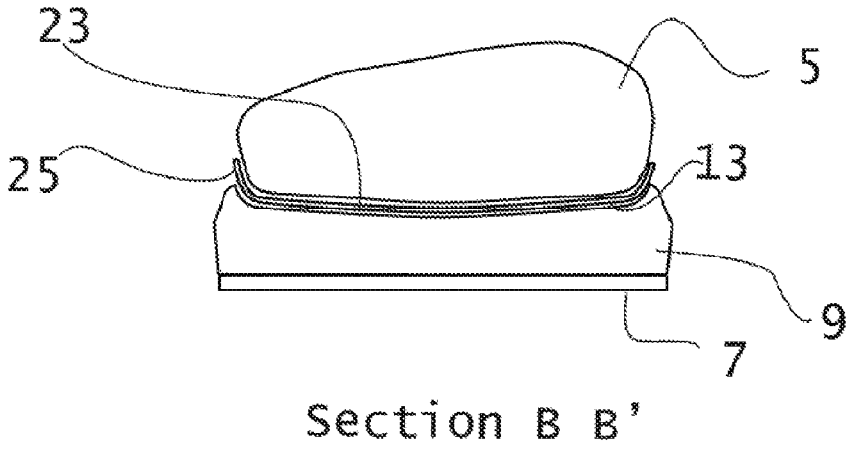
FIG. 6 is a view along cross-section B-B' of FIG. 4.
Figure 5:
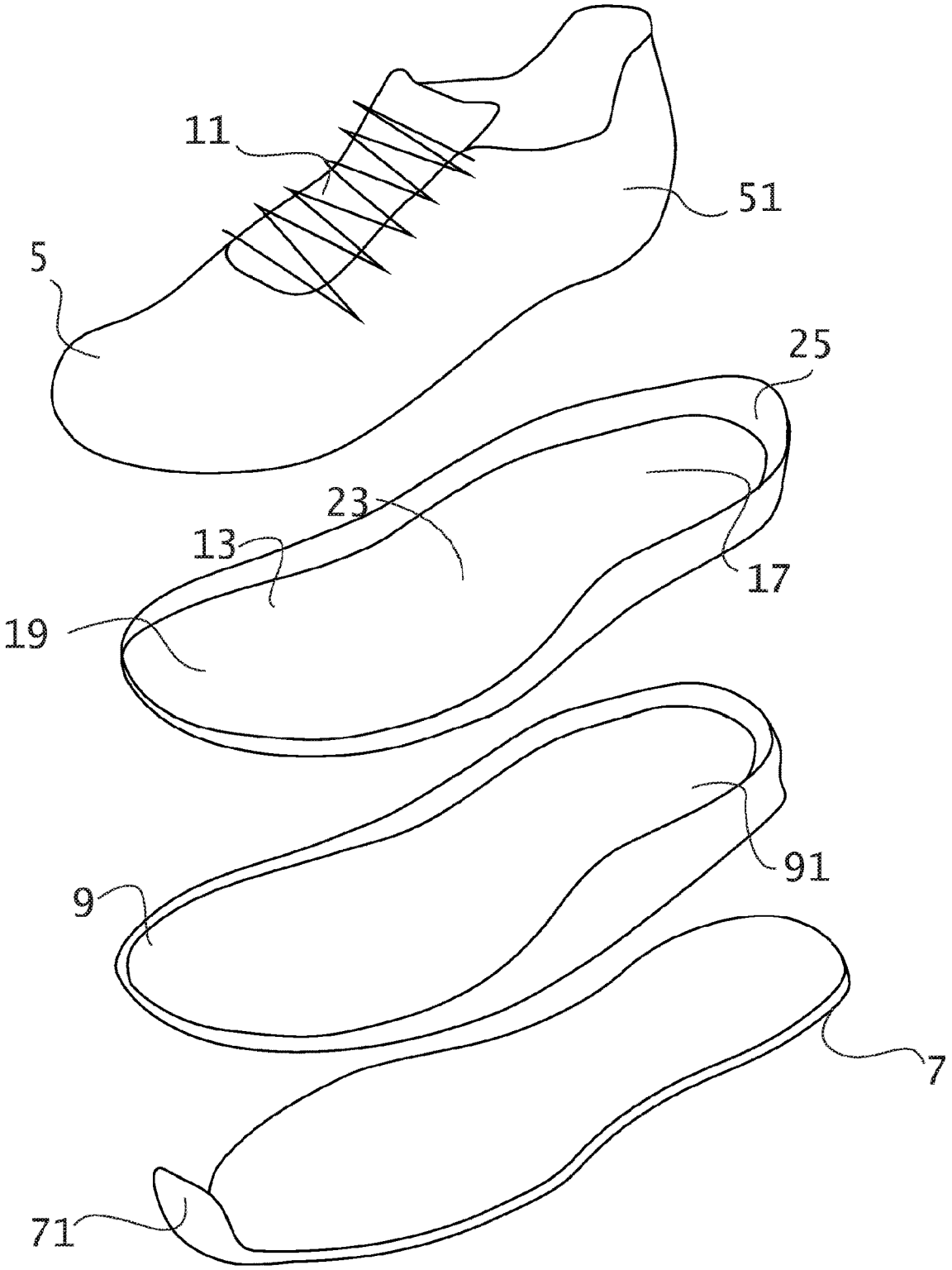
FIG. 5 is an expanded view of FIG. 4.

A second embodiment, illustrated by FIGS. 4 to 6, differs from the previous embodiment in that here, shell side 25 forms an edge around shell bottom 23.

As indicated above, shell side 25 forms an edge around shell bottom 23 to allow shell 13 to stabilize the foot vis-à-vis the ground during a stride, on the one hand. The foot enclosed by upper 5 is thus kept in the alignment held by the shoe at the time of the impact of heel 3 with the ground. On the other hand, the periphery of shell side 25 increases the flexional and torsional rigidity of shell 13. This arrangement is more specifically suitable for road running.

Figure 7:
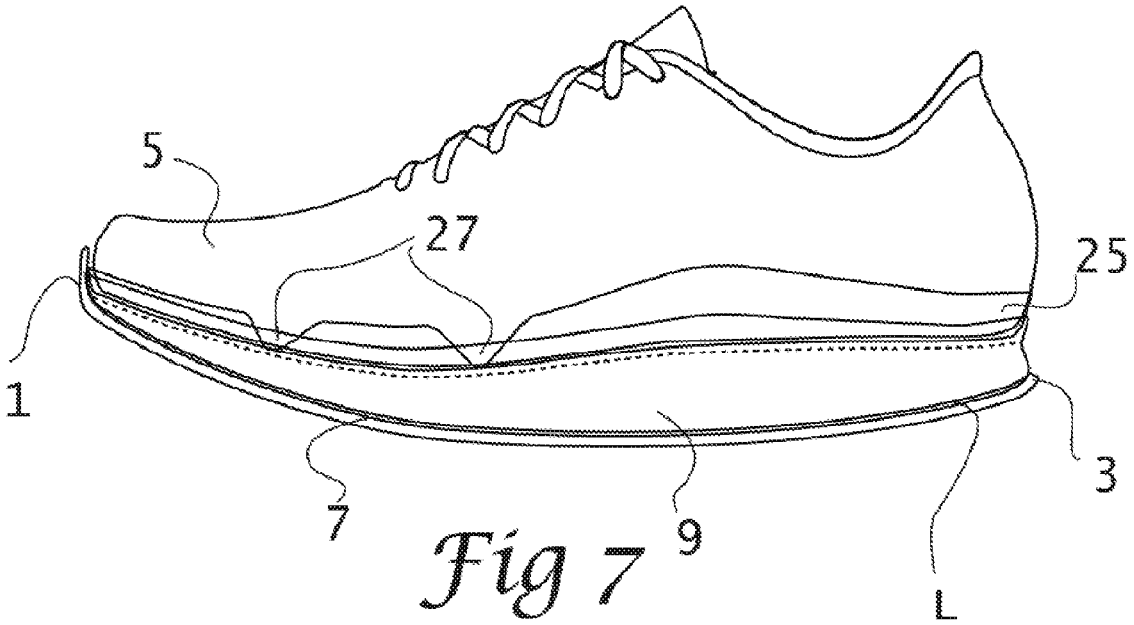
FIG. 7 is a side view of a first variant of the second embodiment of the invention.
Figure 8:
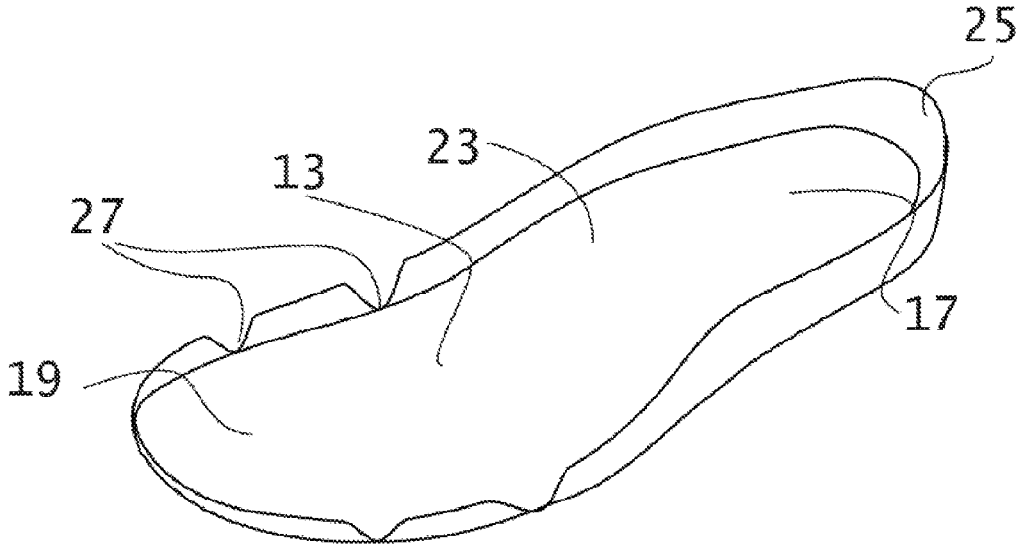
FIG. 8 is a view of the shell of the first variant illustrated in FIG. 7.

As indicated above, this arrangement makes it possible to vary the stiffness of shell 13 by delimiting rigid sections of shell side 25, causing flexibility between the sections due to notches. Notches 27 are arranged along the periphery of shell bottom 13, in front portion 19 of shell 13. As can be seen in FIGS. 7 and 8, each notch includes a lowermost extent that is coincident with the periphery of the shell bottom. Notches 27 correspond, for example, to the position of the joints between the metatarsal and the phalanges and between the phalanges and the toes of the foot. This variant of the embodiment is particularly suitable for mountain runs, known as "trail running".

Figure 9:
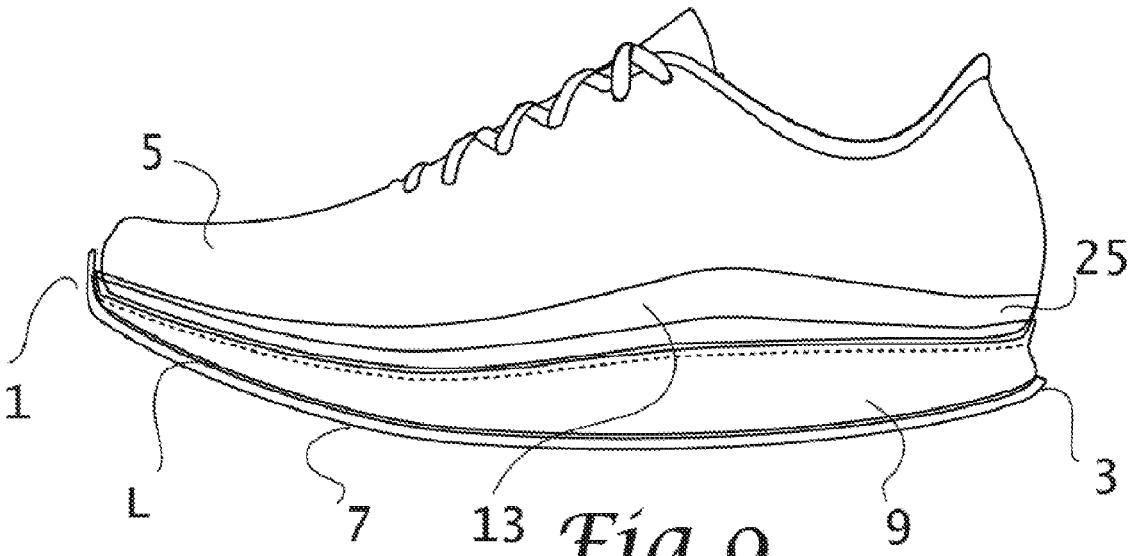
FIG. 9 is a side view of a second variant of the second embodiment of the invention.
Figure 10:
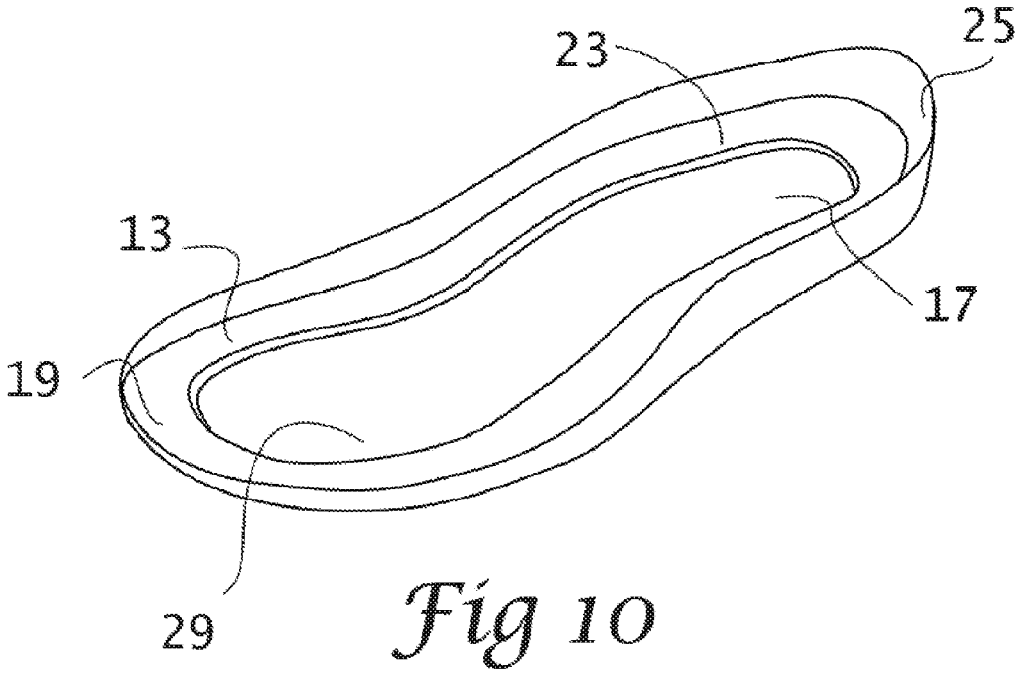
FIG. 10 is a view of the shell of the second variant illustrated in FIG. 9.

According to a second variant of the second embodiment, FIGS. 9 and 10, bottom shell 23 is perforated. Cavity 29 reduces the weight of shell 13 while maintaining the rigidity provided by shell side 25.

In the first or second embodiment, comfort sole 9 has radius of curvature R at any point P on line L from heel 3 to toe 1. In FIGS. 1 and 4, points P1 and P2 of line L have radii of curvature R1 and R2.

As indicated above, the curvature of comfort sole 9 eliminates the overlap effect of the initial impact felt with a comfort sole without curvature. The transition between the impact and the roll of the foot is instantaneous. Combined with the stiffness of composite shell 13, the bend of comfort sole 9 promotes the return of energy and thereby permitting faster, and therefore more powerful, strides.

The shell is preferably made from a polymer resin impregnated with fiberglass or carbon fibers. It can also be manufactured by injection of a thermoplastic or thermosetting material. The torsional and flexional rigidity will be adjusted for a given material according to its thickness and its geometry, in particular the height of the shell side. The comfort layer is preferably made of EVA, but it can also be made of a viscoelastic material or a polyurethane foam.

The shoe construction according to the invention is based on a concept according to which each element of the sole fulfills a distinct function, the modulation of which can be used to respond to different sports practices, be it on the road, on tracks, or in the mountains. It helps keep the foot in place and guide it, and combines cushioning and stride recovery.

We claim:

1. An athletic shoe comprising:

an upper;

a comfort sole; and a shell disposed between the upper and the comfort sole, wherein the shell is attached to one or both of the upper and the comfort sole via a shell bottom and a shell side, wherein the athletic shoe comprises a toe region, wherein the shell side forms an edge that extends upwardly from the shell bottom around a periphery of a rear portion of the shell bottom corresponding to a rear portion of the length of the shell corresponding to a heel of the athletic shoe, wherein the shell side continuously surrounds the rear portion of the shell bottom corresponding with the heel, gradually increases in height along a shell side portion corresponding with a rear middle portion of the athletic shoe, and gradually decreases in height as along a front middle portion of the shell side, wherein the shell side is disconnected along the shell bottom in a front portion of shell corresponding to a toe portion of the athletic shoe to define a plurality of notches arranged at the front portion of the shell, wherein each notch of the plurality of notches includes a lowermost extent that is coincident with the periphery of the shell bottom.

2. The athletic shoe of claim 1, wherein the shell side is configured to provide flexional and torsional rigidity of the shell.

3. The athletic shoe of claim 2, wherein each of the plurality of notches is configured to vary the flexional and torsional rigidity of the shell by delimiting one or more rigid sections of the shell.

4. The athletic shoe of claim 1, wherein at least one of the plurality of notches is configured to correspond to a position of one or more foot joints between one or more metatarsal bones and one or more phalanges of a foot.

5. The athletic shoe of claim 1, wherein at least one of the plurality of notches is configured to correspond to a position of one or more foot joints between one or more between one or more phalanges and one or more toes of a foot.

6. The athletic shoe of claim 1, wherein the shell comprises plastic or composite material.

7. The athletic shoe of claim 6, wherein the shell comprises a polymer resin impregnated with at least one of fiberglass or carbon fibers.

8. The athletic shoe of claim 6, wherein the shell is comprised of an energy releasing composite material configured to allow a fraction of energy released by an impact received by the athletic shoe to be restored during relaxation by reducing a corresponding fraction of energy dissipated by the comfort sole.

9. The athletic shoe of claim 1, wherein the shell bottom is perforated.

10. The athletic shoe of claim 1, wherein the shell bottom further comprises a cavity.

11. The athletic shoe of claim 1, wherein the comfort sole comprises first and second radii of curvature at first and second points along a bottom surface of the comfort sole, wherein a transition between the first and second radii of curvature is configured to reduce an overlap effect of an impact received by the athletic shoe by providing an instantaneous transition between the impact and a roll of the athletic shoe and increasing an energy return during a stride.

12. An athletic shoe comprising:

an outsole configured to grip a surface and provide abrasion resistance;

a comfort sole disposed adjacent the outsole, wherein the comfort sole is less rigid than the outsole and is configured to absorb shock during an impact with the surface;

an upper coupled to the outsole such that the comfort sole is disposed between the outsole and the upper;

a shell disposed between the upper and the comfort sole, the shell comprising a shell bottom and a shell sidewall, wherein the shell sidewall forms an edge that extends upwardly from the shell bottom around a periphery of a rear portion of the shell bottom corresponding to a rear portion of the length of the shell corresponding to a heel of the athletic shoe, wherein the shell sidewall continuously surrounds the rear portion of the shell bottom corresponding with the heel, gradually increases in height along a shell side portion corresponding with a rear middle portion of the athletic shoe, and gradually decreases in height along a front middle portion of the shell sidewall, wherein the shell sidewall is disconnected along the shell bottom in a front portion of shell corresponding to a toe portion of the athletic shoe to define a plurality of notches arranged at the front portion of the shell, such that each notch of the plurality of notches includes a lowermost extent that is coincident with the periphery of the shell bottom, and wherein at least two of the plurality of notches are configured to correspond, respectively, to a position of two or more foot joints between one or more metatarsal bones and one or more phalanges of a foot.

13. The athletic shoe of claim 12, wherein the comfort sole is less rigid than the outsole and has radius of curvature at each point along a line from the heel to the toe portion and creates an interface with the outsole.

14. The athletic shoe of claim 12, wherein the comfort sole has a differing radius of curvature at two or more corresponding points along a line from the heel to the toe portion and creates an interface with the outsole.

15. An athletic shoe comprising:

an outsole comprised of a rubber material configured to grip a surface and provide abrasion resistance, the outsole having a first rigidity;

a comfort sole disposed adjacent the outsole comprised of a foam material, wherein the comfort sole has a second rigidity less than the first rigidity and is configured to absorb shock during an impact with the surface;

an upper coupled to the outsole such that the comfort sole is disposed between the outsole and the upper;

a shell comprised of a polymer resin impregnated with carbon fibers configured to impart torsional and flexional rigidity onto the upper, the shell disposed between the upper and the comfort sole, the shell further comprising a shell bottom and a shell sidewall, wherein the shell sidewall forms an edge that extends upwardly from the shell bottom around a periphery of a rear portion of the shell bottom corresponding to a rear portion of the length of the shell corresponding to a heel of the athletic shoe, wherein the shell sidewall continuously surrounds the rear portion of the shell bottom corresponding with the heel, gradually increases in height along a shell side portion corresponding with a rear middle portion of the athletic shoe, and gradually decreases in height along a front middle portion of the shell sidewall, wherein the shell sidewall is disconnected along the shell bottom in a front portion of shell corresponding to a toe portion of the athletic shoe to define a plurality of notches arranged at the front portion of the shell, such that each notch of the plurality of notches includes a lowermost extent that is coincident with the periphery of the shell bottom, wherein the shell is more rigid than the outsole and, when the athletic shoe is worn, the polymer resin impregnated with carbon fibers comprised by the shell is configured to counteract displacement of a foot enclosed in the upper and restore a fraction of energy released by an impact received by the athletic shoe by reducing a corresponding fraction of energy dissipated by the comfort sole after the impact, and wherein the notches are configured to delimit the rigidity of the forefoot section of the shell, increasing flexibility of shell portions disposed between the notches at specific intervals configured to correspond with a position of one or more joints of the foot.

* * * * *